US010560779B2

(12) United States Patent
Dyreby

(10) Patent No.: US 10,560,779 B2
(45) Date of Patent: Feb. 11, 2020

(54) SOUND RADIATING ARRANGEMENT AND METHOD OF PROVIDING THE SAME

(71) Applicant: BANG & OLUFSEN, Struer (DK)

(72) Inventor: Jakob Dyreby, Struer (DK)

(73) Assignee: BANG & OLUFSEN, Struer (DK)

( * ) Notice: Subject to any disclaimer, the term of this patent is extended or adjusted under 35 U.S.C. 154(b) by 0 days.

(21) Appl. No.: 16/060,684

(22) PCT Filed: Dec. 9, 2016

(86) PCT No.: PCT/DK2016/000048
§ 371 (c)(1),
(2) Date: Jun. 8, 2018

(87) PCT Pub. No.: WO2017/097306
PCT Pub. Date: Jun. 15, 2017

(65) Prior Publication Data

US 2019/0014409 A1 Jan. 10, 2019

(30) Foreign Application Priority Data

Dec. 11, 2015 (DK) ..... 2015 00801

(51) Int. Cl.
*G10K 11/178* (2006.01)
*H04R 1/40* (2006.01)
(Continued)

(52) U.S. Cl.
CPC ..... *H04R 1/403* (2013.01); *H04R 3/12* (2013.01); *H04R 5/02* (2013.01); *H04S 5/005* (2013.01)

(58) Field of Classification Search
CPC .....
H04R 3/005; H04R 2410/07; H04R 2430/20; H04R 2430/21; H04R 2430/23;
(Continued)

(56) References Cited

U.S. PATENT DOCUMENTS 6,015,025 A 1/2000 Mcgrath et al.
2003/0021423 A1* 1/2003 Wood ..... H04S 1/002 381/18
(Continued)

OTHER PUBLICATIONS

International Search Report and Written Opinion dated Jan. 2015 for PCT/DK2016/000048.

*Primary Examiner* — Amir H Etesam
(74) *Attorney, Agent, or Firm* — Hunton Andrews Kurth LLP

(57) ABSTRACT

The invention relates to a sound wall comprising in total M elements comprising a front face (F), where the sound wall (1) has a lateral extension along an x-axis and a vertical extension along a y-axis, where the sound wall (1) comprises N elements (3), where N≤M, which N elements in the front face (F) of each respective of these N elements are provided with a sound radiating unit, such as one or more loudspeaker units, configured to radiate sound energy from the respective front face and into the surroundings, such that a sound field can be created in front of the sound wall; where the sound wall is provided with signal providing means configured to provide the sound radiating units with a signal that is a combination of input signals, such as the left and right channel signals $S_1(t)$, $S_2(t)$ of a stereophonic signal. In embodiments of the invention, the sound wall (1) further comprises A elements (2), where A≤M−N, which A elements (2) are provided with sound absorbing means associated with the front face (F), whereby the sound wall (1) can be used to reduce the reverberation time of a room or other enclosure, in which the sound wall (1) is provided and/or H elements (4), where H≤M−N−A, which H elements (4) comprises hardware components configured to control and provide signals to the sound radiating units in said N elements (3). The invention also relates to a method for controlling a sound field in front of the sound wall.

19 Claims, 3 Drawing Sheets

(51) Int. Cl.

| | |
|---|---|
| ***H04R 3/12*** | (2006.01) |
| ***H04R 5/02*** | (2006.01) |
| ***H04S 5/00*** | (2006.01) |

(58) Field of Classification Search
CPC . H04R 25/407; H04R 1/406; H04R 2201/401
See application file for complete search history.

(56) References Cited

U.S. PATENT DOCUMENTS

| | | | | |
|---|---|---|---|---|
| 2007/0223714 | A1* | 9/2007 | Nishikawa | G10K 11/178 381/71.1 |
| 2008/0159545 | A1* | 7/2008 | Takumai | H04R 1/403 381/17 |
| 2008/0212805 | A1 | 9/2008 | Fincham | |

* cited by examiner

SOUND RADIATING ARRANGEMENT AND METHOD OF PROVIDING THE SAME

CROSS-REFERENCE TO RELATED APPLICATIONS

The present application is a National Stage Application under 35 U.S.C. § 371 of PCT/DK2016/000048, filed Dec. 9, 2016, which claims priority to DK Priority Application Number PA 2015 00801, filed Dec. 11, 2015, the contents of each of which are hereby incorporated by reference in their entireties, for all purposes.

TECHNICAL FIELD

The present invention relates generally to loudspeaker systems and more specifically to such systems comprising a plurality of loudspeakers configured to provide a sound image, such as a monophonic sound image or a stereophonic sound image or a multichannel sound image, in a listening room.

BACKGROUND OF THE INVENTION

A traditional stereophonic (or other kind of multi-channel) loudspeaker system comprises at least two, and often more, separate loudspeaker boxes or cabinets provided with loudspeaker units. Although there exist many examples of compact loudspeaker boxes or cabinets that may fit into the interior design of a living room, customers may desire a loudspeaker setup that does not appear as a loudspeaker setup in the traditional form but rather as a decorative element of for instance a wall portion of the room, in a manner for instance somewhat similar to that of a large flat TV screen. Furthermore, a traditional stereophonic (or other multi-channel) loudspeaker setup may create a sound image that is near to optimal within a very limited region in the listening room, but much inferior at other locations in the room. Specifically, it may be desirable to be able for the user to change the optimal listening position or region from one region in the room to others, without having to move the loudspeakers to other positions in the room, which may be difficult or even impossible due to the placement of other furniture in the room.

It would therefore be advantageous to have access to a loudspeaker setup in which the optimal listening position or region can be changed by simple operations on a user interface or the like and which setup would not appear as one or more loudspeaker boxes or cabinets in the traditional sense, but rather as an entity or concept, the appearance of which could be adapted easily to the desires of the user.

DISCLOSURE OF THE INVENTION

On the above background it is an object of the present invention to provide a sound generating entity or concept that will make it possible to adapt the optimal listening position or region to the needs of a specific user.

It is a further object of the invention to provide a sound radiating entity or concept, the appearance of which could be adapted easily to the desires of the user.

It is a further object of the invention to provide a sound radiating entity or concept, where the appearance of the entity or concept can easily be changed according to changing desires of a user.

The above and further objects and advantages are obtained by a sound wall and a method according to the present invention.

According to a first aspect of the present invention there is provided a sound wall comprising in total M elements comprising a front face F, where the sound wall has a lateral extension along an x-axis and a vertical extension along a y-axis, where the sound wall comprises N elements of a first kind, where N M, which N elements in the front face F of each respective of these N elements are provided with a sound radiating unit, such as one or more loudspeaker units, configured to radiate sound energy from the respective front face and into the surroundings, such that a sound field can be created in front of the sound wall; where the sound wall is provided with signal providing means configured to provide the sound radiating units with a signal that is a combination of processed or unprocessed input signals.

Such input signals could for instance specifically be two input signals: $S_1(t)$, $S_2(t)$, such as the left and right channel signals of a stereophonic signal, but according to the invention other numbers of input signals could also be used, and all such numbers of input signals would fall within the scope of the present invention.

The processing could comprise frequency dependent or independent gain adjustment and time delay of the individual input signals.

Above and in the following the terms "elements" and "modules" are both used to designate the physical entities used in the invention.

Generally, according to the invention, the signal provided to the individual sound radiating units can be defined by the following expression:

$$S_{Ti} = \sum_{n=1}^{NI} G_n z^{-D_n} S_{In}$$

where $S_{Ti}$ is the signal to sound radiating unit no. i, $S_{In}$ is the input signal no. n, NI is the total number of input signals, $G_n$ is the gain provided to input signal no. n and $D_n$ is the delay of input signal no. n.

In an embodiment of the first aspect, NI is equal to two, such as the left and right signal of a stereophonic signal.

In an embodiment of the first aspect the sound wall further comprises A elements of a second kind, where A≤M−N, which A elements are provided with sound absorbing means associated with the front face, whereby the sound wall can be used to reduce the reverberation time of a room or other enclosure, in which the sound wall is provided. The sound absorbing elements furthermore reduce unwanted sound reflections from elements adjacent to those containing loudspeaker units caused by sound energy emitted by such units and reflected from adjacent elements in the sound wall.

In an embodiment of the first aspect the sound wall further comprises H elements of a third kind, where H≤M−N−A, which H elements comprises hardware components configured to control and/or provide signals to the sound radiating units in said N elements.

In an embodiment of the first aspect the elements have substantially rectangular or square front faces.

In an embodiment of the first aspect the elements have substantially hexagonal front faces.

In an embodiment of the first aspect the sound wall is provided with a control system comprising:

an input terminal configured to receive an input signal comprising at least a left signal L(t) and a right signal R(t), such as a stereophonic signal;

controllable signal combining units configured to combine at least two signals $S_1(t)$ and $S_2(t)$ to a combined output signal O(t);

controllable signal routing units configured receive combined output signals from the signal combining units and to route combined output signals to one or more of said sound radiating units;

at least one controlling unit configured to control said signal combining units and said signal routing units, whereby each respective of said sound radiating units receive a chosen combination of combined output signals.

In an embodiment of the first aspect the sound wall comprises eight sound radiating units (L1, L2, L3, L4, L5, L6, L7, L8) provided at different positions (x1, x2, x3, x4, x5, x6, x7, x8) along the x-axis with x1≤x2≤x3≤x4≤x5≤x6≤x7≤x8, where said combining units and said routing units are configured to provide each respective of the sound radiating units with the following signal combinations:

$$O_1(t)=S_1(t)+S_2(t) \quad \text{L1:}$$

$$O_2(t)=S_1(t)-S_2(t) \quad \text{L2:}$$

$$O_3(t)=S_1(t)+S_2(t) \quad \text{L3:}$$

$$O_4(t)=S_2(t)-S_1(t) \quad \text{L4:}$$

$$O_5(t)=S_1(t)-S_2(t) \quad \text{L5:}$$

$$O_6(t)=S_1(t)+S_2(t) \quad \text{L6:}$$

$$O_7(t)=S_2(t)-S_1(t) \quad \text{L7:}$$

$$O_8(t)=S_1(t)+S_2(t) \quad \text{L8:}$$

In an embodiment of the first aspect the sound wall comprises eight sound radiating units (L1, L2, L3, L4, L5, L6, L7, L8) provided at different positions (x1, x2, x3, x4, x5, x6, x7, x8) along the x-axis with x1≤x2≤x3≤x4≤x5≤x6≤x7≤x8, and where said combining units and said routing units are configured to provide each respective of the sound radiating units with the following signal combinations:

$$O_1(t)=S_1(t)-S_2(t) \quad \text{L1:}$$

$$O_2(t)=S_2(t)-S_1(t) \quad \text{L2:}$$

$$O_3(t)=S_1(t) \quad \text{L3:}$$

$$O_4(t)=S_1(t)+S_2(t) \quad \text{L4:}$$

$$O_5(t)=S_1(t)+S_2(t) \quad \text{L5:}$$

$$O_6(t)=S_2(t) \quad \text{L6:}$$

$$O_7(t)=S_1(t)-S_2(t) \quad \text{L7:}$$

$$O_8(t)=S_2(t)-S_1(t) \quad \text{L8:}$$

In the detailed description of the invention, the sound radiating units (a total of eight in the embodiments shown) are located at different positions along the x-axis. As defined above, it would also according to the invention be possible to provide more than one sound radiating unit above each other in the vertical direction, i.e. at the same position along the x-axis. Such embodiments are also within the scope of the present invention.

In an embodiment of the first aspect the front faces of the respective modules are configured for attachment and removal on/from the respective module, whereby the appearance of the respective module can be adapted to the desires of the user and/or whereby repair and replacement of the front faces can easily be performed. Preferably, the modules are provided with such attachment means the attachment and/or removal of the front face from the module can take place without removal of the module from the sound wall.

According to a second aspect of the present invention there is provided a method for creating and controlling a sound field in front of a sound wall, where the sound wall has a lateral extension along an x-axis and a vertical extension along a y-axis, which sound wall comprises N modules of a first kind each comprising sound radiating units, such as loudspeakers, the modules being provided at predetermined positions in the sound wall and where the units are configured to radiate sound energy to the region in front of the sound wall, where the method comprises providing said sound radiating units with a signal that is a combination of processed or unprocessed input signals, such as the left and right channel signals $S_1(t)$, $S_2(t)$ of a stereophonic signal.

Such input signals could for instance specifically be two input signals: $S_1(t)$, $S_2(t)$, such as the left and right channel signals of a stereophonic signal, but according to the invention other numbers of input signals could also be used, and all such numbers of input signals would fall within the scope of the present invention.

The processing could comprise frequency dependent or independent gain adjustment and time delay of the individual input signals.

Generally, according to the invention, the signal provided to the individual sound radiating units can be defined by the following expression:

$$S_{Ti} = \sum_{n=1}^{NI} G_n z^{-D_n} S_{In}$$

where $S_{Ti}$ is the signal to sound radiating unit no. i, $S_{In}$ is the input signal no. n, NI is the total number of input signals, $G_n$ is the gain provided to input signal no. n and $D_n$ is the delay of input signal no. n.

In an embodiment of the second aspect, NI is equal to two, such as the left and right signal of a stereophonic signal.

In an embodiment of the second aspect of the present invention the sound wall has a lateral extension along an x-axis and a vertical extension along a y-axis, where the sound wall comprises N modules of a first kind, each comprising sound radiating units, such as loudspeakers, the modules being provided at predetermined positions in the sound wall and where the units are configured to radiate sound energy to the region in front of the sound wall, where the method comprises:

providing one or more input signals;

providing controllable signal combining units configured to combine said input signals to a combined output signal;

providing controllable signal routing units configured to route signals to one or more of said sound radiating units;

providing at least one controlling unit configured to control said signal combining units and said signal routing units;

distributing the modules of the first kind laterally at positions x1, x2, x3, . . . xN in the sound wall;

providing said input signals, or processed versions hereof, as respective input signals to one or more of said controllable signal combining units to obtain a combined output signal from respective signal combining units;

routing said combined signals from the respective signal combining units to respective of said sound radiating units;

whereby said sound radiating units will create a sound field in front of the sound wall that is based on a combination of said one or more input signals.

In an embodiment of the second aspect of the present invention the sound wall has a lateral extension along an x-axis and a vertical extension along a y-axis, where the sound wall comprises N modules of a first kind, each comprising sound radiating units, such as loudspeakers, the modules being provided at predetermined positions in the sound wall and where the units are configured to radiate sound energy to the region in front of the sound wall, where the method comprises:

providing an input signal comprising at least a left signal L(t) and a right signal R(t), such as a stereophonic signal;

providing controllable signal combining units configured to combine at least two signals $S_1(t)$ and $S_2(t)$ to a combined output signal O(t);

providing controllable signal routing units configured to route signals to one or more of said sound radiating units;

providing at least one controlling unit configured to control said signal combining units and said signal routing units;

distributing the modules of the first kind laterally at lateral positions x1, x2, x3, . . . xN in the sound wall;

providing said left signal L(t) and a right signal R(t), or processed versions hereof, as respective input signals $S_1(t)$ and $S_2(t)$ to one or more of said controllable signal combining units to obtain a combined output signal O(t) from respective signal combining units;

routing said combined signals from the respective signal combining units to respective of said sound radiating units;

whereby said sound radiating units will create a sound field in front of the sound wall that is based on a combination of said left signal L(t) and said right signal R(t).

In an embodiment of the second aspect, more than one sound radiating unit is positioned at the same position along the x-axis in the sound wall.

In an embodiment of the second aspect the combined output signal O(t) is a linear combination of the corresponding input signals to the specific combining unit:

$$O_i(t)=a_{1i}In_i+a_{2i}In_{i2} \text{ where } a_{1i}=0,1,-1 \text{ and } a_{2i}=0,1,-1$$

and i designates the respective signal combining unit.

In an embodiment of the second aspect the processing resulting in said processed versions of the input signals comprises any one of or any combination of filtering, equalization, delay and gain adjustment.

In an embodiment of the second aspect the signal components of the input signals, or of the processed versions hereof, below a predefined lower limiting frequency $F_L$ are provided to all sound radiating units in the sound wall.

In an embodiment of the second aspect the signal components of the input signals, or of the processed versions hereof, below a predefined lower limiting frequency $F_L$ are provided to chosen sound radiating units.

In an embodiment of the second aspect the signal components of the input signals, or of the processed versions hereof, below a predefined lower limiting frequency $F_L$ are provided to one or more dedicated sound radiating units, such as subwoofers.

Both within the context of the first and the second aspect of the invention, embodiments are possible wherein no modules of the third kind (modules containing hardware for instance to receive, process and route signals to various sound radiating units) are used. In these embodiments, the hardware is instead provided in modules of the first and/or second kind.

In further embodiments of the first and second aspects of the invention, modules of the first kind and modules of the second kind are provided, for instance by providing a portion of the front face of sound radiating units with suitably configured damping/sound absorbing material.

The sound wall according to the invention provides a flexible solution to the problem of how to create a sound field in a room, such as a listening room, that can be adapted to the specific needs of listeners in that room. The modular nature of the sound wall according to the invention facilitates adaptation to a large number of different wall configurations, including walls with door or window openings or walls, in which openings through the sound wall must be provided for installation of other entities on the wall, such as TV screens or pictures. Furthermore, by providing the front faces of the modules with a suitable covering material, the appearance of the sound wall according to the invention can be adapted to specific wishes and it also becomes easy to change the appearance of the sound wall, if desired, or to replace the covering of the modules for repair, if needed.

BRIEF DESCRIPTION OF THE DRAWINGS

Further benefits and advantages of the present invention will become apparent after reading the detailed description of non-limiting exemplary embodiments of the invention in conjunction with the accompanying drawings, wherein.

DETAILED DESCRIPTION OF THE INVENTION

In the following a detailed description of an example embodiment of the invention is given. It is, however understood that the principles of the invention could be embodied in other ways.

The sound wall concept is a wall mounted loudspeaker installation where the customer has an opportunity to influence the visual appearance of the setup. Further, the concept is scalable such that the concept is usable in a broad variety of room sizes.

Figure 1:
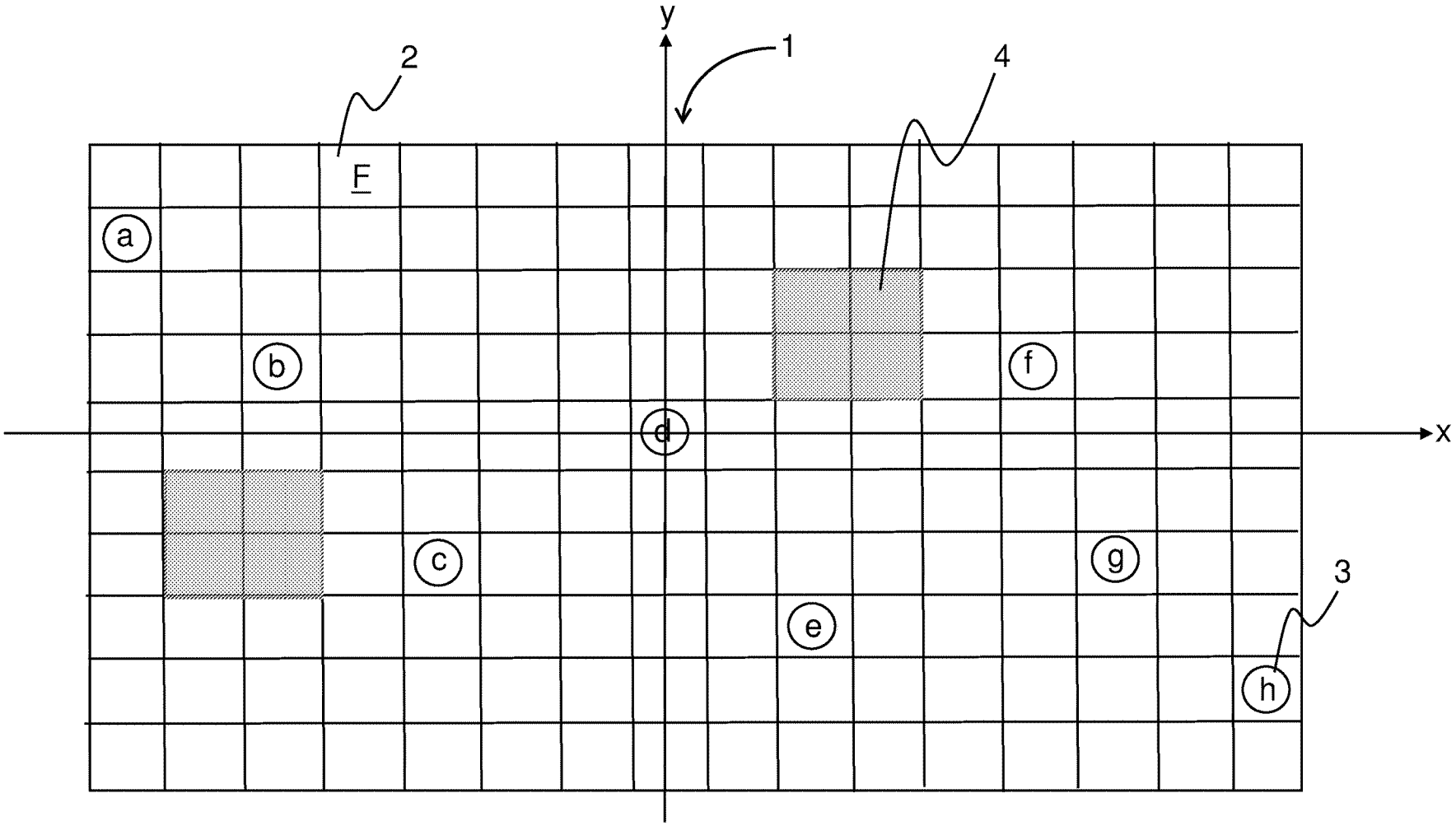
FIG. 1 shows a schematic plane view of an embodiment of a sound wall according to the invention comprising modules with rectangular or square front faces of which eight are provided with loudspeakers configured to generate a sound field in front of the sound wall.
Figure 2:
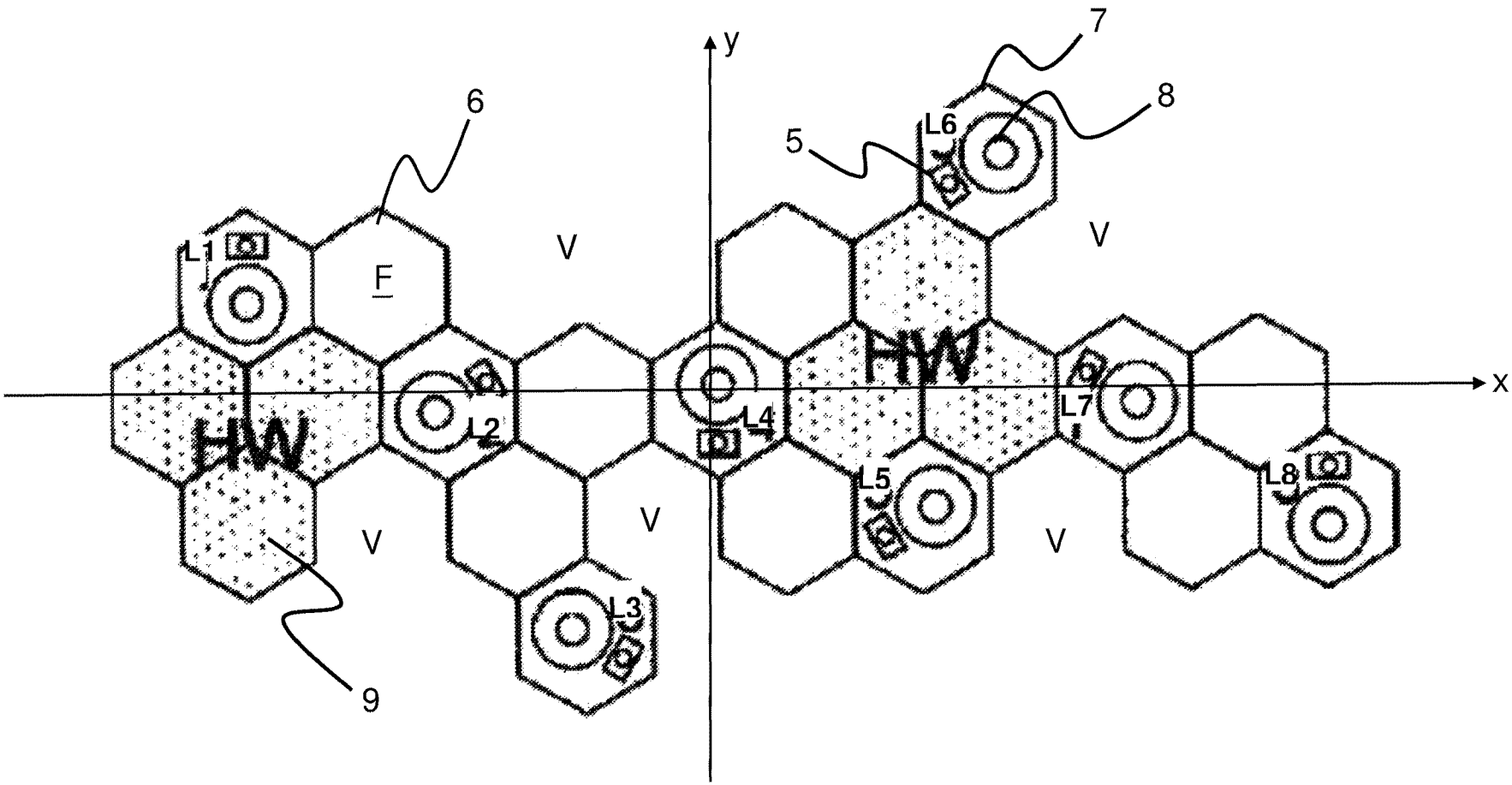
FIG. 2 shows a schematic plane view of another embodiment of a sound wall according to the invention comprising modules with hexagonal front faces of which eight are provided with loudspeakers configured to generate a sound field in front of the sound wall.

Physical Setup:

According to an embodiment of the invention, the sound wall consists of a number of modules that can for instance have a rectangular, square or hexagonal shape of the front face, which modules are arranged to the desire of the customer. FIGS. 1 and 2 shows example embodiments of the setup. In these embodiments there are three different kinds of modules:

1) Speaker modules: These may contain any number of individual loudspeaker units, such as for instance a woofer and a tweeter unit.

2) Hardware modules: Contains hardware that may feed electrical signals to a fixed number of speaker modules. The hardware may be housed in more than one hardware module. In the embodiment shown in FIG. 1, four adjacent square modules 4 contain hardware and in the embodiment shown in FIG. 2 three adjacent hexagonal modules 9 contain hardware.

3) Passive absorption modules: Contains acoustic absorption to reduce the reverberation time of the room.

A fabric frame that may use different fabrics and colors as desired by the customer may cover the respective modules.

Signal Processing:

In an embodiment of the invention the input signal to the sound wall is a normal two-channel stereo signal that consists of a left and a right signal.

Further, the sum of the left and right signal and the difference between the left and right signal are calculated as described above.

These four signals may be fed to the individual speaker modules in any combination and—if desired—with different levels, frequency weightings and time delays.

In order to maximize the low frequency output it is possible to provide all speaker hexagons with the same low frequency signal.

To reduce room influence, room compensation can be incorporated in the system.

EXAMPLES

The following four examples show some of the possibilities of the sound wall according to the present invention. In all examples, the signal below $f_L$=100 Hz is provided to all speakers, but it is understood that $f_L$ may be chosen differently, inter alia dependent on the frequency response and maximum output characteristic of the specific loudspeaker units used in the sound wall.

(1) Mono: The sum of the left and right signals are fed to speaker d in FIG. 1 or L4 in FIG. 2. This setup will make the entire sound image appear at the position of speaker d or L4, respectively, no matter where the listener is situated. Therefore, speech intelligibility is high and the sound stage is stable. The level will increase closer to the speaker d or L4, respectively.

(2) Stereo: The left channel is fed to loudspeaker b in FIG. 1 or to L2 in FIG. 2 and the right channel is fed to loudspeaker g in FIG. 1 or to L7 in FIG. 2. This distribution will create a sweet spot stereo image in the plane where the distances from the listener to the loudspeakers b and g, or L2 and L7, respectively, are equal. However, if the distances are different the correlated signal between left and right (such as a lead vocalist) will appear closer to the speaker that is closest to the listener. The position of the sweet spot may be changed by adjusting the gain and delay between the speakers b and g, or L2 and L7, respectively.

(3) Following sound stage: The signals are routed as follows (c.f. FIG. 2):

$$O_1(t)=S_1(t)+S_2(t) \quad \text{L1:}$$

$$O_2(t)=S_1(t)-S_2(t) \quad \text{L2:}$$

$$O_3(t)=S_1(t)+S_2(t) \quad \text{L3:}$$

$$O_4(t)=S_2(t)-S_1(t) \quad \text{L4:}$$

$$O_5(t)=S_1(t)-S_2(t) \quad \text{L5:}$$

$$O_6(t)=S_1(t)+S_2(t) \quad \text{L6:}$$

$$O_7(t)=S_2(t)-S_1(t) \quad \text{L7:}$$

$$O_8(t)=S_1(t)+S_2(t) \quad \text{L8:}$$

This channel distribution will make the correlated signal components appear in the closer speaker. As the speakers are mounted on a flat wall, a lead vocalist will appear to be in front of the listener from all listening positions in front of the sound wall. Since all speakers are sharing the signal, the level will be more constant in front of the sound wall compared to the mono or stereo scenario. Further, this distribution will be less influenced by an obstruction between the speaker and the listener.

(4) Constant sound stage: The signals are routed as follows:

$$O_1(t)=S_1(t)-S_2(t) \quad \text{L1:}$$

$$O_2(t)=S_2(t)-S_1(t) \quad \text{L2:}$$

$$O_3(t)=S_1(t) \quad \text{L3:}$$

$$O_4(t)=S_1(t)+S_2(t) \quad \text{L4:}$$

$$O_5(t)=S_1(t)+S_2(t) \quad \text{L5:}$$

$$O_6(t)=S_2(t) \quad \text{L6:}$$

$$O_7(t)=S_1(t)-S_2(t) \quad \text{L7:}$$

$$O_8(t)=S_2(t)-S_1(t) \quad \text{L8:}$$

This channel distribution will make the correlated signal components appear in the middle of the sound wall from all listening positions. Therefore, the reproduced sound will appear as if the lead vocalist is standing in the centre with the orchestra distributed around the vocalist. Since all loudspeakers are sharing the same signal, the level will be more constant in front of the sound wall compared to the mono or stereo scenario. Further, this distribution will be less influenced by the obstruction between a speaker and a listener.

It is understood that other signal routings would be possible, and also that the sound wall according to the invention can contain more or fewer loudspeakers than shown in the example embodiments shown in FIGS. 1 and 2, respectively.

With reference to FIG. 1 there is shown a schematic plane view of an embodiment of a sound wall according to the invention. The sound wall according to this embodiment is generally indicated by reference numeral 1 and comprises a plurality of elements with a front face F. The shown embodiment comprises three different types of elements:

(i) elements 2 (shown with white front faces in FIG. 1) that contain acoustic absorbing means in the front face configured to reduce the reverberation time of a room in which the sound wall is installed.

(ii) elements 3 in which the front face is provided with one or more loudspeaker units. Eight such elements designated a, b, c, d, e, f, g and h are provided in the embodiment shown in FIG. 1, but it is understood that other numbers of such elements can be provided in the sound wall if desired.

(iii) elements 4 (shown with shaded front faces in FIG. 1) that contain various hardware (if desired configured to run software for processing signals and controlling the sound wall) configured for use in the sound wall, for instance to route signals to the various loudspeakers. Two groups of such elements are shown in FIG. 1 each comprising four elements, but it is understood that other numbers of such elements can be provided in the sound wall if desired.

With reference to FIG. 2 there is shown a schematic plane view of another embodiment of a sound wall according to the invention comprising modules with hexagonal front faces F of which eight are provided with loudspeakers configured to generate a sound field in front of the sound wall. The sound wall according to this embodiment comprises the loudspeakers designated by L1, L2 . . . L8. As in the embodiment shown in FIG. 1, the embodiment in FIG. 2 comprises modules 6 provided with sound absorbing means and modules 9 containing hardware/software components for processing and control of the signals provided to the loudspeakers L1, L2 . . . L8.

As it appears from FIG. 2, the sound wall according to the invention may not necessarily cover an entire surface portion of for instance a wall of a room (as for instance the embodiment shown in FIG. 1). Certain areas V may be left open to occupy for instance windows, doors or other structures in the room.

Figure 3:
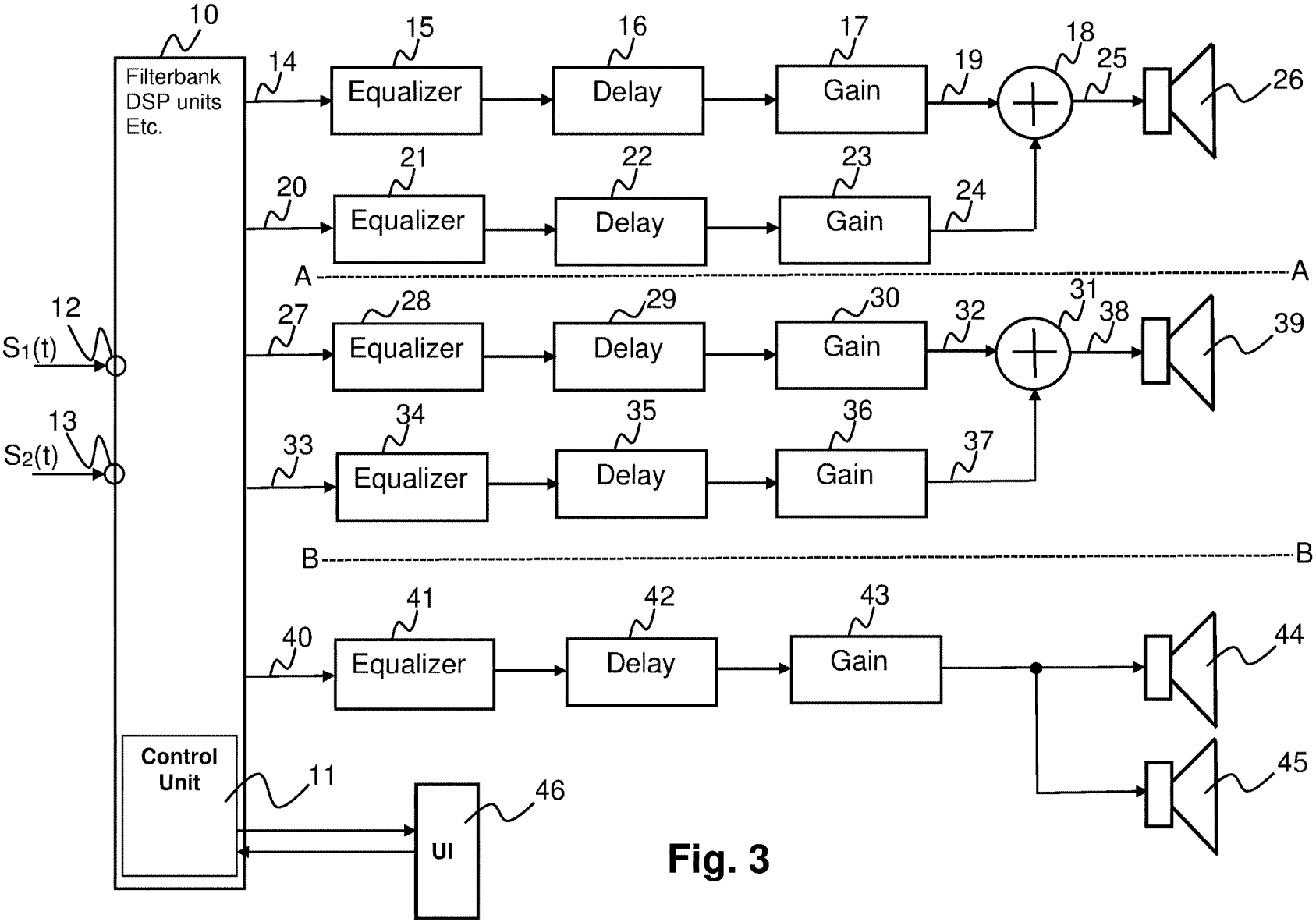
FIG. 3 shows a schematic block diagram of a system configured to process, control and route signals to the various loudspeakers in the sound wall.

With reference to FIG. 3 there is shown a schematic block diagram of a system configured to process, control and route signals to the various loudspeakers in the sound wall. It should however be noted that the principles of the invention can be implemented by other systems than the one shown in FIG. 3.

The system shown in FIG. 3 is provided with a block 10 provided with input terminals 12, 13 for a left and right channel stereophonic signal $S_1(t)$ and $S_2(t)$, respectively. Block 10 further contains a filter bank configured to subdivide the audible frequency range into a low, medium and high frequency range. By way of example only, the low frequency band may extend from approximately 100 Hz downwards, the mid frequency band may cover the frequency range from approximately 100 Hz to 4 kHz and the high frequency band may extend from 4 kHz upwards. The upper and lower frequency limits of the respective bands will of cause depend inter alia on the specific loudspeaker units used in the sound wall.

Block 10 further contains a control unit 11 configured to control the various functional blocks in the system. Thus, the control unit 11 may in some embodiments of the sound wall be configured to control both the respective equalizers 15, 21, 28, 34, 41, the respective delays 16, 22, 29, 35, 42, the respective gain units 17, 23, 30, 36, 43 and the adders 18, 31. The control signal lines connecting the control unit 11 with the respective functional blocks of the system are left out in FIG. 3 for clarity. Thus all equalizers, delay units, gain units and adders, or a predefined subset of these, are configured as controllable by the control unit 11.

The sound wall may comprise a large number of loudspeakers. However, in FIG. 3 only four such loudspeakers 26, 39, 44, 45 are shown. Loudspeaker 26 is a high frequency loudspeaker (tweeter), loudspeaker 39 is a low/mid frequency loudspeaker and loudspeakers 44 and 45 are low frequency loudspeakers (woofers).

From the filter bank in block 10 there is provided high frequency left and right stereo signals 14 and 20, respectively. The left high frequency band 14 is provided to the input of equalizer 15 and from the output hereof to the input of the delay unit 16. The output from delay unit 16 is provided to a frequency independent gain unit 17 and from this to the adder 18. The right high frequency band 20 is provided to the input of equalizer 21 and from the output hereof to the input of the delay unit 22. The output from delay unit 22 is provided to a frequency independent gain unit 23 and from this to the adder 18.

The adder 18 comprises two inputs 19 and 24 and a single output 25, These are respectively designated by $In_{HF1}$, $In_{HF2}$ and $O_{HF}$. The adder 18 is configured with the following input-output relations:

$$O_{HF}=a_1In_{HF1}+a_2In_{HF2} \text{ where } a_1=0,1,-1 \text{ and } a_2=0,1,-1 \qquad \text{Adder 18:}$$

Thus adder 18 may provide an output signal that is equal to a single of the two input signals or the sum or difference between the two input signals.

In FIG. 3 the broken line A-A indicates that although only a single high frequency loudspeaker 26 is shown, there may be a plurality of such loudspeakers distributed appropriately over the sound wall according to the invention.

From the filter bank in block 10 there is further provided mid or mid/low frequency left and right stereo signals 27 and 33, respectively. The left mid or mid/low frequency band 27 is provided to the input of equalizer 28 and from the output hereof to the input of the delay unit 29. The output from delay unit 29 is provided to a frequency independent gain unit 30 and from this to the adder 31. The right mid or mid/low frequency band 33 is provided to the input of equalizer 34 and from the output hereof to the input of the delay unit 35. The output from delay unit 35 is provided to a frequency independent gain unit 36 and from this to the adder 31.

The adder 31 comprises two inputs 32 and 37 and a single output 38, These are respectively designated by $In_{MF1}$, $In_{MF2}$ and $O_{MF}$. The adder 31 is configured with the following input-output relations:

$$O_{MF}=a_1In_{MF1}+a_2In_{MF2} \text{ where } a_1=0,1,-1 \text{ and } a_2=0,1,-1 \qquad \text{Adder 31:}$$

Thus adder 31 may provide an output signal that is equal to a single of the two input signals or the sum or difference between the two input signals.

In FIG. 3 the broken line B-B indicates that although only a single mid or mid/low frequency loudspeaker 39 is shown, there may be a plurality of such loudspeakers distributed appropriately over the sound wall according to the invention.

In the embodiment of the invention shown in FIG. 3 there is further provided a single low frequency signal 40 from the filter bank in block 10. In this embodiment, signal 40 is the sum of low frequency left and right stereo signals provided by respective low pass filters in the filter bank. After appropriate equalization, delay and gain adjustment in blocks 41, 42 and 43, respectively, the combined low frequency signal is provided to a plurality (possibly all) low frequency loudspeakers in the sound wall. Only two such loudspeakers 44, 45 are shown in FIG. 3, but it is understood that a larger number of low frequency loudspeakers could be used. It would alternatively be possible to have only a single, powerful low frequency loudspeaker in the sound wall.

However, if the low frequency sound energy is distributed over a large number of loudspeakers, the maximum power output of the sound wall at low frequencies may be increased, without the need to use large and powerful low frequency loudspeakers.

It is understood that in other embodiments of the invention the respective equalizers, delay units, gain units and adders may be incorporated as an integral part of block 10. Further, in some embodiments it may not be necessary to apply equalization, delay and gain adjustment of the different signals, and in such embodiments the respective functional blocks shown in FIG. 3 may be omitted.

In order to render the sound wall controllable by the user, a user interface 46 may in certain embodiments be incorporated in the system as shown in FIG. 3.

In the sound wall according to the invention, corresponding high, mid and low frequency loudspeakers, i.e. loudspeakers that are intended to radiate sound energy from substantially the same position in the sound wall, may be integrated into a single module as shown in module 7 in FIG. 2 by reference numerals 5 and 8, but they can alternatively be mounted in separate modules. Specifically, the low frequency loudspeakers (woofers) may be mounted in separate modules and for instance located centrally in the sound wall. The location of the low frequency loudspeakers is not essential for the functioning of the sound wall, as auditory localization ability is poor at low frequencies.

In an embodiment of the sound wall according to the invention, one or more dedicated low frequency loudspeakers (woofers) that only handle the low frequencies are not used. Instead a common low frequency signal is determined and this signal is routed to all mid/low frequency loudspeaker units in the sound wall, whereas the mid frequency signal is handled and distributed among the respective loudspeakers as described above.

Although the invention has been explained in relation to the embodiments described above, it is to be understood that many other possible modifications and variations can be made without departing from the scope of the present invention.

The invention claimed is:

1. A sound radiating arrangement comprising:

M elements comprising a front face, wherein the sound radiating arrangement has a lateral extension along an x-axis and a vertical extension along a y-axis;

N elements, wherein N≤M; which N elements in the front face of each respective of the N elements are provided with a sound radiating unit, such as one or more loudspeaker units, configured to radiate sound energy from the respective front face and into the surroundings, such that a sound field is creatable in front of the sound radiating arrangement, wherein the sound radiating arrangement includes a signal providing apparatus configured to provide an individual unit of said sound radiating units with a signal that is a combination of processed or unprocessed left and right channel signals of a stereophonic signal;

an input terminal configured to receive an input signal comprising said left and right signals of the stereophonic signal;

controllable signal combining units configured to combine said left and right signals to one or more combined output signals;

controllable signal routing units configured to (i) receive said one or more combined output signals from the signal combining units and (ii) selectively route said one or more combined output signal to one or more of said sound radiating units; and at least one control unit configured to control said signal combining units and said signal routing units, wherein each respective of said sound radiating units receives a selected combination of said one or more combined output signals.

2. The sound radiating arrangement according to claim 1, wherein the signal provided to the individual sound radiating units is defined by the following expression:

$$S_{Ti} = \sum_{n=1}^{2} G_n z^{-D_n} S_{In}$$

wherein $S_{Ti}$ is the signal to sound radiating unit no. i, $S_{In}$ is the input signal no. n. $G_n$ is the gain provided to input signal no. n and $D_n$ is the delay of input signal no. n.

3. The sound radiating arrangement according to claim 1, wherein the processing resulting in processed versions of input signals comprises any one of or any combination of filtering, equalization, delay and gain adjustment.

4. The sound radiating arrangement according to claim 1, further comprising elements, wherein A≥1, wherein A elements include a sound absorbing configuration associated with the front face, and wherein the sound radiating arrangement is usable to reduce a reverberation time of a room or other enclosure, in which the sound radiating arrangement is provided.

5. The sound radiating arrangement according to claim 4, further comprising H elements, wherein H≥1, wherein said H elements comprises hardware components configured to control and provide signals to the sound radiating units in said N elements.

6. The sound radiating arrangement according to claim 5, wherein said N, A and H elements have substantially rectangular or square front faces.

7. The sound radiating arrangement according to claim 5, wherein said N, A and H elements have substantially hexagonal front faces.

8. The sound radiating arrangement according to claim 1, further comprising at least eight sound radiating units (L1, L2, L3, L4, L5, L6, L7, L8) provided at respective positions (x1, x2, x3, x4, x5, x6, x7, x8) along the x-axis with x1≤x2≤x3≤x4≤x5≤x6≤x7≤x8, wherein said combining units and said routing units are configured to provide each respective one of the sound radiating units with the following signal combinations of respective ones of said combined output signals:

$$O_1(t)=S_1(t)+S_2(t) \quad \text{L1:}$$

$$O_2(t)=S_1(t)-S_2(t) \quad \text{L2:}$$

$$O_3(t)=S_1(t)+S_2(t) \quad \text{L3:}$$

$$O_4(t)=S_2(t)-S_1(t) \quad \text{L4:}$$

$$O_5(t)=S_1(t)-S_2(t) \quad \text{L5:}$$

$$O_6(t)=S_1(t)+S_2(t) \quad \text{L6:}$$

$$O_7(t)=S_2(t)-S_1(t) \quad \text{L7:}$$

$$O_8(t)=S_1(t)+S_2(t) \quad \text{L8.}$$

9. The sound radiating arrangement according to claim 1, further comprising at least eight sound radiating units (L1, L2, L3, L4, L5, L6, L7, L8) provided at respective positions (x1, x2, x3, x4, x5, x6, x7, x8) along the x-axis with x1≤x2≤x3≤x4≤x5≤x6≤x7≤x8, wherein the combining units and said routing units are configured to provide each respective one of the sound radiating units with the following signal combinations of respective ones of said combined output signals:

$$O_1(t)=S_1(t)-S_2(t) \quad \text{L1:}$$

$$O_2(t)=S_5(t)-S_1(t) \quad \text{L2:}$$

$$O_3(t)=S_1(t) \quad \text{L3:}$$

$$O_4(t)=S_1(t)+S_2(t) \quad \text{L4:}$$

$$O_5(t)=S_1(t)+S_2(t) \quad \text{L5:}$$

$$O_6(t)=S_2(t) \quad \text{L6:}$$

$$O_7(t)=S_1(t)-S_2(t) \quad \text{L7:}$$

$$O_8(t)=S_2(t)+S_1(t) \quad \text{L8.}$$

10. A method for generating and controlling a sound field in front of a sound wall, where the sound radiating arrangement comprising M elements including a front face, wherein the sound radiating arrangement has a lateral extension along an x-axis and a vertical extension along a y-axis, wherein the sound radiating arrangement comprises N modules of a first type each comprising sound radiating units, the N modules being provided at predetermined positions in the sound wall where the sound radiating units are configured to radiate sound energy to the region in front of the sound radiating arrangement, wherein the method comprises:

providing said sound radiating units with a signal that is a combination of processed or unprocessed and right channel signals of a stereophonic signal;

providing an input signal comprising a left signal and a right signal of the stereophonic signal;

providing controllable signal combining units configured to combine at least two channel signals to a combined output signal;

providing controllable signal routing units configured to selectively route signals to one or more of said sound radiating units;

providing at least one controller unit configured to control said signal combining units and said signal routing units;

providing said left and right signals or processed versions hereof, as respective input signals to one or more of said controllable signal combining units to obtain the combined output signal from said respective signal combining units; and with said controllable signal routing units, selectively routing said combined output signal from the respective signal combining units to respective ones of said sound radiating units, wherein said sound radiating units are configured to generate a sound field in front of the sound radiating arrangement that is based on a combination of said left signal and said right signal.

11. The method according to claim 10, wherein the signal provided to the individual ones of said sound radiating units is defined by the following expression:

$$S_{Ti} = \sum_{n=1}^{NI} G_n z^{-D_n} S_{In}$$

wherein $S_{Ti}$ is the signal to sound radiating unit no. i, $S_{In}$ is the input signal no. n, NI is the total number of input signals, $G_n$ is the gain provided to input signal no. n and $D_n$ is the delay of input signal no. n.

12. The method according to claim 10, wherein the processing resulting in processed versions of the input signals comprises any one of or any combination of filtering, equalization, delay or gain adjustment.

13. The method according to claim 10, further comprising:

distributing the N modules of the first type laterally at lateral positions x1, x2, x3, . . . xN in the sound radiating arrangement.

14. The method according to claim 10, wherein said combined output signal is a linear combination of the corresponding input signals to a specific one of said controllable signal combining units as follows:

$$O_i(t)=a_{1i}In_i+a_{2i}In_{i2} \text{ where } a_{1i}=0,1,-1 \text{ and } a_{2i}=0,1,-1$$

and i designates the respective signal combining unit.

15. The method according to claim 10, wherein signal components of the input signals, or of the processed versions thereof, which are below a predefined lower limiting frequency $F_L$ are provided to all of said sound radiating units in the sound radiating arrangement.

16. The method according to claim 10, wherein signal components of the input signals, or of the processed versions hereof, which are below a predefined lower limiting frequency $F_L$ are provided to chosen ones of said sound radiating units.

17. The method according to claim 10, wherein signal components of the input signals, or of the processed versions hereof, which are below a predefined lower limiting frequency $F_L$ are provided to one or more dedicated ones of said sound radiating units.

18. The method according to claim 10, wherein said radiating arrangement comprises at least eight sound radiating units (L1, L2, L3, L4, L5, L6, L7, L8) provided at respective positions (x1, x2, x3, x4, x5, x6, x7, x8) along the x-axis with x1≤x2≤x3≤x4≤x5≤x6≤x7≤x8, and the method further comprising:

providing, with said combining units and said routing units, each respective one of the sound radiating units with the following signal combinations of respective ones of said combined output signals:

$$O_1(t)=S_1(t)+S_2(t) \quad \text{L1:}$$

$$O_2(t)=S_1(t)-S_2(t) \quad \text{L2:}$$

$$O_3(t)=S_1(t)+S_2(t) \quad \text{L3:}$$

$$O_4(t)=S_2(t)-S_1(t) \quad \text{L4:}$$

$$O_5(t)=S_1(t)-S_2(t) \quad \text{L5:}$$

$$O_6(t)=S_1(t)+S_2(t) \quad \text{L6:}$$

$$O_7(t)=S_2(t)-S_1(t) \quad \text{L7:}$$

$$O_8(t)=S_1(t)+S_2(t) \quad \text{L8.}$$

19. The method according to claim 10, wherein said radiating arrangement comprises eight sound radiating units (L1, L2, L3, L4, L5, L6, L7, L8) provided at respective positions (x1, x2, x3, x4, x5, x6, x7, x8) along the x-axis with $x1 \leq x2 \leq x3 \leq x4 \leq x5 \leq x6 \leq x7 \leq x8$, and the method further comprising:

providing, with said combining units and said routing units, each respective one of the sound radiating units with the following signal combinations of respective ones of said combined output signals:

$O_1(t)=S_1(t)+S_2(t)$ L1:

$O_2(t)=S_2(t)-S_1(t)$ L2:

$O_3(t)=S_1(t)$ L3:

$O_4(t)=S_1(t)-S_2(t)$ L4:

$O_5(t)=S_1(t)-S_2(t)$ L5:

$O_6(t)=S_2(t)$ L6:

$O_7(t)=S_1(t)-S_2(t)$ L7:

$O_8(t)=S_2(t)-S_1(t)$ L8.

* * * * *